US008702523B2

(12) United States Patent
David et al.

(10) Patent No.: US 8,702,523 B2
(45) **Date of Patent: *Apr. 22, 2014**

(54) ACHIEVEMENT INCENTIVES WITHIN A CONSOLE-BASED GAMING ENVIRONMENT

(75) Inventors: Jonathan Todd David, Seattle, WA (US); Gregory Joseph Canessa, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 33 days.

This patent is subject to a terminal disclaimer.

(21) Appl. No.: 13/347,028

(22) Filed: Jan. 10, 2012

(65) Prior Publication Data

US 2012/0108347 A1 May 3, 2012

Related U.S. Application Data

(63) Continuation of application No. 11/599,777, filed on Nov. 15, 2006, now Pat. No. 8,113,951.

(51) Int. Cl.
*A63F 9/24* (2006.01)

(52) U.S. Cl.
USPC ..... 463/42; 705/40; 705/59

(58) Field of Classification Search
USPC ..... 463/20–42; 705/40, 59; 717/11, 117
See application file for complete search history.

(56) References Cited

U.S. PATENT DOCUMENTS

| | | | |
|---|---|---|---|
| 5,708,709 | A | 1/1998 | Rose |
| 5,883,955 | A | 3/1999 | Ronning |
| 6,226,618 | B1 | 5/2001 | Downs et al. |
| 6,334,214 | B1 | 12/2001 | Horstmann |
| 2002/0120577 | A1 | 8/2002 | Hans et al. |
| 2003/0074657 | A1 | 4/2003 | Bramley |
| 2003/0181242 | A1 | 9/2003 | Lee et al. |
| 2005/0055309 | A1 | 3/2005 | Williams et al. |
| 2005/0257054 | A1 | 11/2005 | Tucker et al. |
| 2006/0064761 | A1 | 3/2006 | Multerer et al. |
| 2006/0080702 | A1 | 4/2006 | Diez et al. |
| 2006/0191016 | A1 | 8/2006 | Ostergren et al. |

OTHER PUBLICATIONS

"Game Demo", Wikipedia, Nov. 6, 2005, at http://web.archive.org/web/20051109174400/http://en.wikipedia.org/wiki/Game_demo.*

Amendment After Final filed Sep. 9, 2011 in related U.S. Appl. No. 11/599,777, filed Nov. 15, 2006, 5 pgs.

Amendment filed Jun. 2, 2011 in related U.S. Appl. No. 11/599,777, filed Nov. 15, 2006, 7 pgs.

Amendment (with filing of RCE) filed Feb. 5, 2010 in related U.S. Appl. No. 11/599,777, filed Nov. 15, 2006, 6 pgs.

Final Office Action dated Jun. 22, 2011 in related U.S. Appl. No. 11/599,777, filed Nov. 15, 2006, 28 pgs.

Final Office Action dated Dec. 11, 2009 in related U.S. Appl. No. 11/599,777, filed Nov. 15, 2006, 9 pgs.

Notice of Allowance dated Oct. 11, 2011 in related U.S. Appl. No. 11/599,777, filed Nov. 15, 2006, 7 pgs.

(Continued)

*Primary Examiner* — Steve Rowland

(74) *Attorney, Agent, or Firm* — Micah Goldsmith; Glen Johnson; Micky Minhas

(57) ABSTRACT

A computer-implemented method is disclosed for encouraging downloads of a game. The method includes displaying an achievement advertisement and subsequently receiving input indicative of the achievement advertisement. The input is responded to by displaying a download component related to a game associated with the achievement advertisement.

18 Claims, 7 Drawing Sheets

(56) References Cited

OTHER PUBLICATIONS

Official Action dated Apr. 29, 2009 in related U.S. Appl. No. 11/599,777, filed Nov. 15, 2006, 9 pgs.

Official Action dated May 12, 2011 in related U.S. Appl. No. 11/599,777, filed Nov. 15, 2006, 13 pgs.

Response filed Aug. 6, 2009 in related U.S. Appl. No. 11/599,777, filed Nov. 15, 2006, 7 pgs.

* cited by examiner

ACHIEVEMENT INCENTIVES WITHIN A CONSOLE-BASED GAMING ENVIRONMENT

CROSS-REFERENCE TO RELATED APPLICATION

The present application is a continuation of and claims priority of U.S. patent application Ser. No. 11/599,777, filed Nov. 15, 2006, the content of which is hereby incorporated by reference in its entirety.

BACKGROUND

Historically, gaming consoles have been dedicated to devices that connect to a monitor and that allow a user to play a game stored on a game cartridge or disc that is inserted into the gaming console. Thus, the games available to a user were provided on gaming modules or optical discs that the user had to purchase and bring home. When a user wanted to play a game, the user had to insert the module or disc into the gaming console. The game would typically automatically start when it was inserted into the console. When the user desired to play a different game, the existing game had to be removed from the gaming console and the new game had to be inserted into the gaming console.

Traditionally, gaming consoles had also been isolated from other devices other than a television monitor. As such, they were not viewed as devices that could be networked.

This changed with the introduction of the Microsoft XBox gaming console which provided network connectivity for the gaming console. To take advantage of this network connectivity, Microsoft introduced a gaming disc known as Microsoft Arcade, which was able to connect to a server through the Internet when the gaming console was connected to the Internet. The server site that the Arcade disc could reach was dedicated to XBox consoles that were executing the Arcade application stored on the Arcade disc. As such, other devices could not reach this server site, and further, XBox consoles that did not have the Arcade gaming disc running, could not reach the server site.

Microsoft eventually released a newer version of their gaming console called the Xbox 360, which also provided support for network connectivity. Microsoft directly integrated Arcade functionality into the Xbox 360 gaming console. Thus, users gained the ability to reach the server site and access Arcade functionality without having to install a dedicated Arcade gaming disc. Currently, the Xbox 360 gaming console is the latest available version of a gaming console in the Xbox product category.

From the server site, the Arcade components integrated into the Xbox 360 gaming console are able to enumerate full version games that are stored on the server and that can be downloaded to the user's hard disc drive on the XBox 360 console. The XBox 360 supports the display of games that are available on the server, with games that have not been previously been downloaded being displayed in a different manner than games that have been downloaded. By selecting one of the games that has not been downloaded, the user is able to download the game onto their hard disc drive for a fee.

Microsoft Arcade was the first service to introduce a "try before you buy" sales model in the console gaming industry. In accordance with this model, a user can download and play a limited portion of a game for little or no fee, and then subsequently convert to a full version for a fee when and if desired. This sales model was introduced in association with the Xbox console and was also included within the Arcade platform associated with the Xbox 360 console. These experiences have shown that it is desirable, at least based on a goal of increasing sales revenue, to employ effective means for driving higher trial downloads and conversion rates to the full version of each game.

The discussion above is merely provided for general background information and is not intended for use as an aid in determining the scope of the claimed subject matter.

SUMMARY

A computer-implemented method is disclosed for encouraging downloads of a game. The method includes displaying an achievement advertisement and subsequently receiving input indicative of the achievement advertisement. The input is responded to by displaying a download component related to a game associated with the achievement advertisement.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
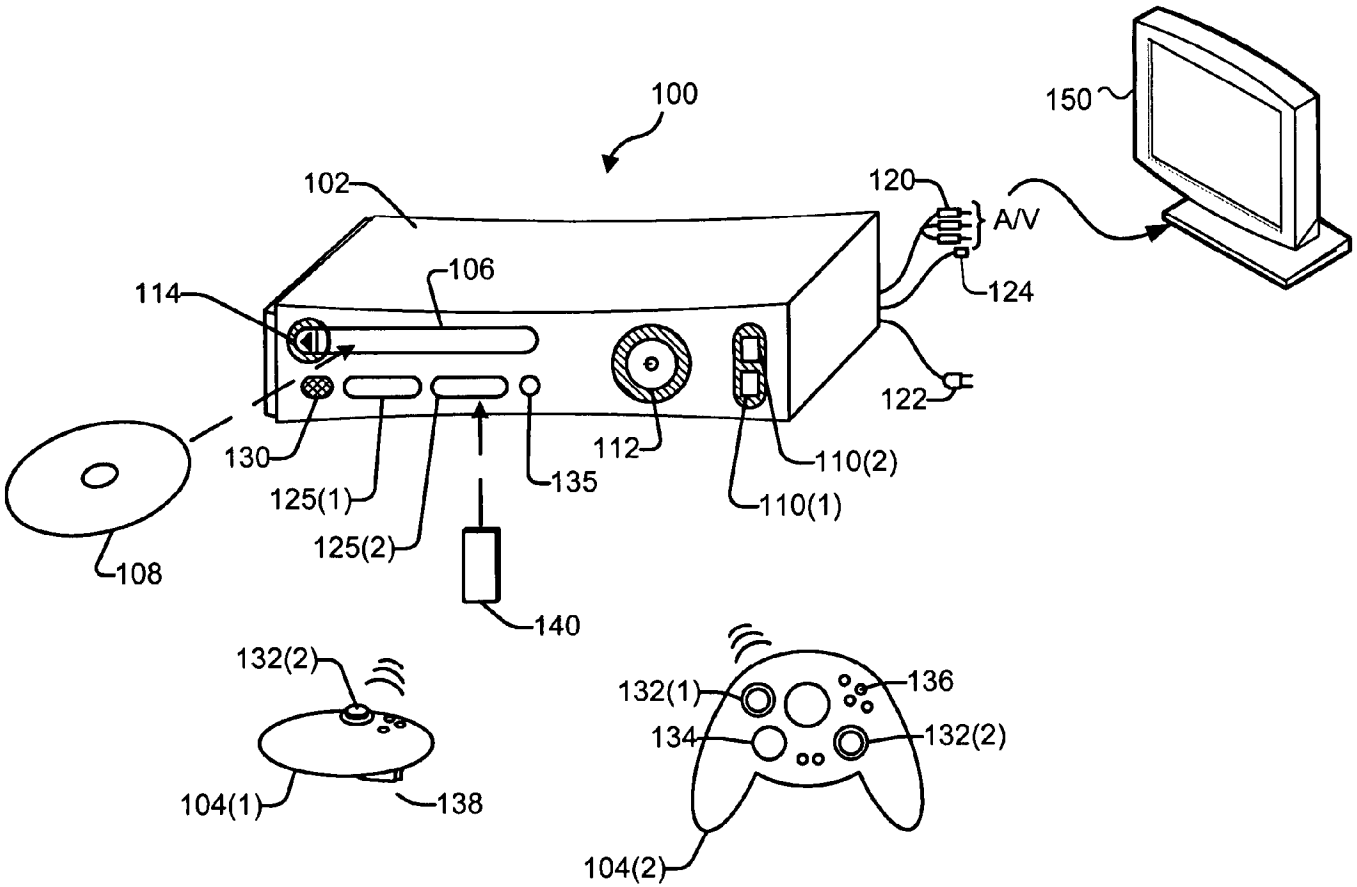
FIG. 1 is a diagram of external components of a gaming console.

FIG. 1 illustrates an example of a gaming and media system 100 that may be part of an environment in which embodiments can be implemented. System 100 is but one example of a suitable computing system and is not intended to suggest any limitation as to the scope of use or functionality of the claimed subject matter. Neither should system 100 be interpreted as having any dependency or requirement relating to any one or combination of illustrated components.

Gaming and media system 100 includes a game and media console (hereinafter simply "console" or "game console") 102. Console 102 is configured to accommodate one or more wireless controllers, as represented by controllers 104(1) and 104(2). Further, console 102 is equipped with an internal hard disk drive (not shown), and a portable media drive 106 that supports various forms of portable storage media, as represented by optical storage disc 108. Examples of suitable portable storage media include DVD, CD-ROM, game discs, and so forth. Console 102 also includes two memory unit card receptacles 125(1) and 125(2), for receiving removable flash-type memory units 140. A command button 135 on console 102 enables and disables wireless peripheral support.

As depicted in FIG. 1, console 102 also includes an optical port 130 for communicating wirelessly with one or more devices and two Universal Serial Bus (USB) ports 110(1) and 110(2) to support a wired connection for additional controllers, or other peripherals. In some implementations, the number and arrangement of additional ports may be modified. A power button 112 and an eject button 114 are also positioned on the front face of game console 102. Power button 112 is selected to apply power to the game console, and can also provide access to other features and controls, and eject button 114 alternately opens and closes the tray of portable media drive 106 to enable insertion and extraction of a storage disc 108.

Console 102 connects to a television or other display via A/V interfacing cables 120. In one implementation, console 102 is equipped with a dedicated A/V port (not shown) configured for content-secured digital communication using A/V cables 120 (e.g., A/V cables suitable for coupling to a High Definition Multimedia Interface "HDMI" port on a high definition monitor 150 or other display device). A power cable 122 provides power to the game console. Console 102 may be further configured with broadband capabilities, as represented by a cable or modem connector 124 to facilitate access to a network, such as the Internet.

Each controller 104 is coupled to console 102 via a wired or wireless interface. In the illustrated implementation, the controllers are USB-compatible and are coupled to console 102 via a wireless interface or USB port 110. Console 102 may be equipped with any of a wide variety of user interaction mechanisms. In the example illustrated in FIG. 1, each controller 104 is equipped with two thumbsticks 132(1) and 132(2), a D-pad 134, buttons 136, and two triggers 138. These controllers are merely representative, and other known gaming controllers may be substituted for, or added to, those shown in FIG. 1.

Gaming and media system 100 is generally configured for interacting with games and other electronic content stored on a memory medium (internal and/or portable), shopping for and purchasing products such as electronic media including game and game component downloads, and reproducing prerecorded music and videos, from both electronic and hard media sources. With the different storage offerings, titles can be played from the hard disk drive, from optical disk media (e.g., 108), from an online source, or from a memory unit 140 connected to one of the receptacles 125. A sample, certainly not by limitation, of some of the types of media that gaming and media system 100 is capable of playing include 1) game titles played from CD and DVD discs, from the hard disk drive, or from an online source; 2) Digital music played from a CD in portable media drive 106, from a file on the hard disk drive, or from online streaming sources; and 3) Digital audio/video played from a DVD disc in portable media drive 106, from a file on the hard disk drive, or from online streaming sources.

Figure 2:
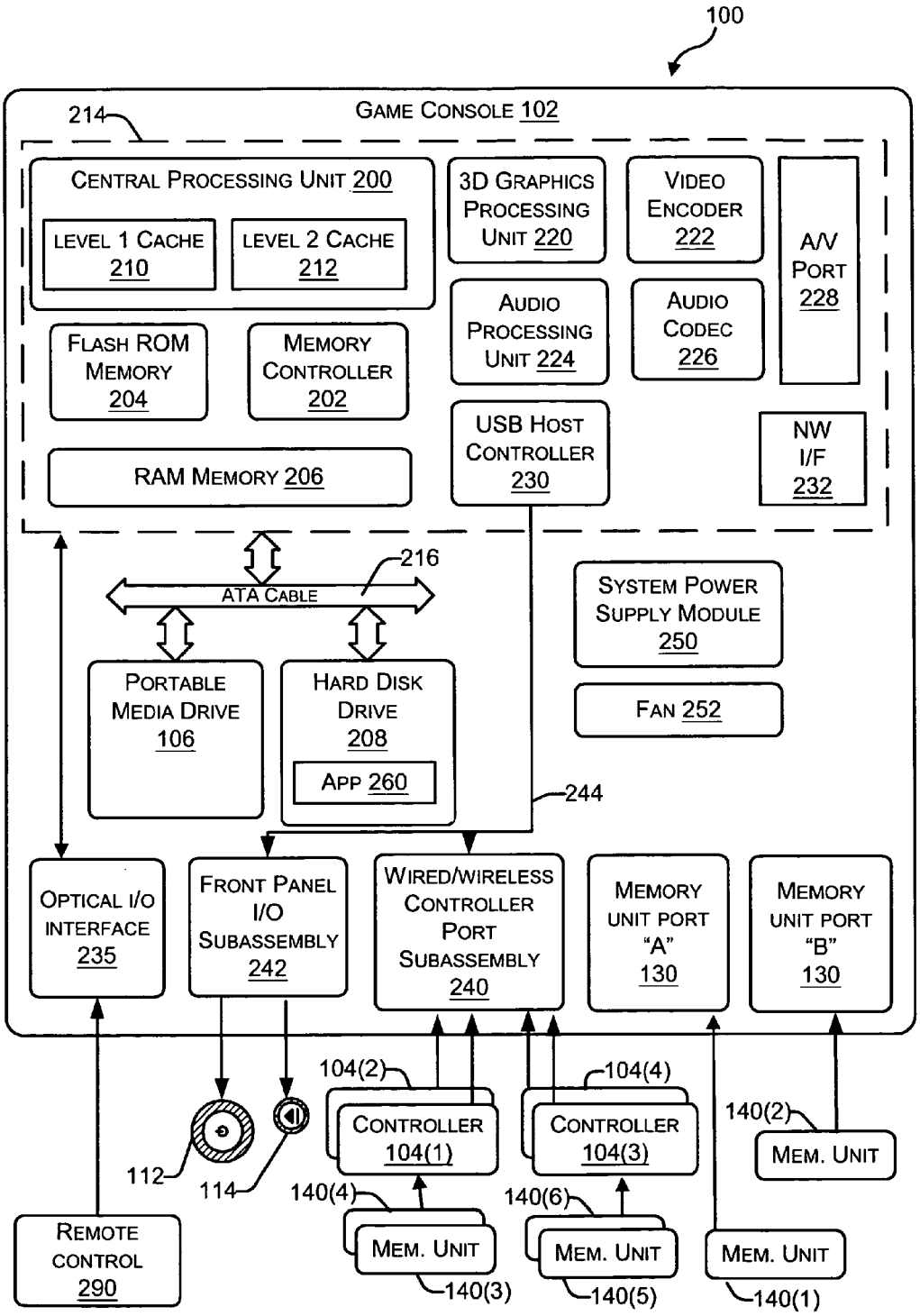
FIG. 2 is a block diagram of internal components of a gaming console.

FIG. 2 is a functional block diagram of gaming and media system 100 and shows functional components in more detail. Console 102 has a central processing unit (CPU) 200, and a memory controller 202 that facilitates processor access to various types of memory, including a flash Read Only Memory (ROM) 204, a Random Access Memory (RAM) 206, a hard disk drive 208, and portable media drive 106. In one implementation, CPU 200 includes a level 1 cache 210, and a level 2 cache 212 to temporarily store data and hence reduce the number of memory access cycles made to the hard drive, thereby improving processing speed and throughput.

CPU 200, memory controller 202, and various memory devices are interconnected via one or more buses (not shown). The details of the bus that is used in this implementation are not particularly relevant to understanding the subject matter of interest being discussed herein. However, it will be understood that such a bus might include one or more of serial and parallel buses, a memory bus, a peripheral bus, and a processor or local bus, using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, and a Peripheral Component Interconnects (PCI) bus also known as a Mezzanine bus.

In one implementation, CPU 200, memory controller 202, ROM 204, and RAM 206 are integrated onto a common module 214. In this implementation, ROM 204 is configured as a flash ROM that is connected to memory controller 202 via a Peripheral Component Interconnect (PCI) bus and a ROM bus (neither of which are shown). RAM 206 is configured as multiple Double Data Rate Synchronous Dynamic RAM (DDR SDRAM) modules that are independently controlled by memory controller 202 via separate buses (not shown). Hard disk drive 208 and portable media drive 106 are shown connected to the memory controller via the PCI bus and an AT Attachment (ATA) bus 216. However, in other implementations, dedicated data bus structures of different types can also be applied in the alternative.

A three-dimensional graphics processing unit 220 and a video encoder 222 form a video processing pipeline for high speed and high resolution (e.g., High Definition) graphics processing. Data are carried from graphics processing unit 220 to video encoder 222 via a digital video bus (not shown). An audio processing unit 224 and an audio codec (coder/decoder) 226 form a corresponding audio processing pipeline for multi-channel audio processing of various digital audio formats. Audio data are carried between audio processing unit 224 and audio codec 226 via a communication link (not shown). The video and audio processing pipelines output data to an A/V (audio/video) port 228 for transmission to a television or other display. In the illustrated implementation, video and audio processing components 220-228 are mounted on module 214.

FIG. 2 shows module 214 including a USB host controller 230 and a network interface 232. USB host controller 230 is shown in communication with CPU 200 and memory controller 202 via a bus (e.g., PCI bus) and serves as host for peripheral controllers 104. Network interface 232 provides access to a network (e.g., Internet, home network, etc.) and may be any of a wide variety of various wire or wireless interface components including an Ethernet card, a modem, a Bluetooth module, a cable modem, and the like.

In the implementation depicted in FIG. 2, console 102 includes a controller support subassembly 240, for supporting four controllers 104(1)-104(4). The controller support subassembly 240 includes any hardware and software components needed to support wired and wireless operation with an external control device, such as for example, a media and game controller. A front panel I/O subassembly 242 supports the multiple functionalities of power button 112, the eject button 114, as well as any LEDs (light emitting diodes) or other indicators exposed on the outer surface of console 102. Subassemblies 240 and 242 are in communication with module 214 via one or more cable assemblies 244. In other implementations, console 102 can include additional controller subassemblies. The illustrated implementation also shows an optical I/O interface 235 that is configured to send and receive signals that can be communicated to module 214.

Memory units (MUs) 140(1) and 140(2) are illustrated as being connectable to MU ports "A" 130(1) and "B" 130(2), respectively. Each MU 140 offers additional storage on which games, game parameters, and other data may be stored. In some implementations, the other data can include any one or more of a digital game component, an executable gaming application, an instruction set for expanding a gaming application, and a media file. When inserted into console 102, MU 140 can be accessed by memory controller 202.

A system power supply module 250 provides power to the components of gaming system 100. A fan 252 cools the circuitry within console 102.

An application 260 comprising machine instructions is stored on hard disk drive 208. When console 102 is powered on, various portions of application 260 are loaded into RAM 206, and/or caches 210 and 212, for execution on CPU 200. In general, application 260 can include one or more program modules for performing various display functions, such as controlling dialog screens for presentation on a display (e.g., high definition monitor 150), controlling transactions based on user inputs and controlling data transmission and reception between the console 100 and externally connected devices.

Gaming system 100 may be operated as a standalone system by simply connecting the system to high definition monitor 150 (FIG. 1), a television, a video projector, or other display device. In this standalone mode, gaming system 100 enables one or more players to play games, or enjoy digital media, e.g., by watching movies, or listening to music. However, with the integration of broadband connectivity made available through network interface 232, gaming system 100 may further be operated as a participating component in a larger network gaming community or system.

Figure 3:
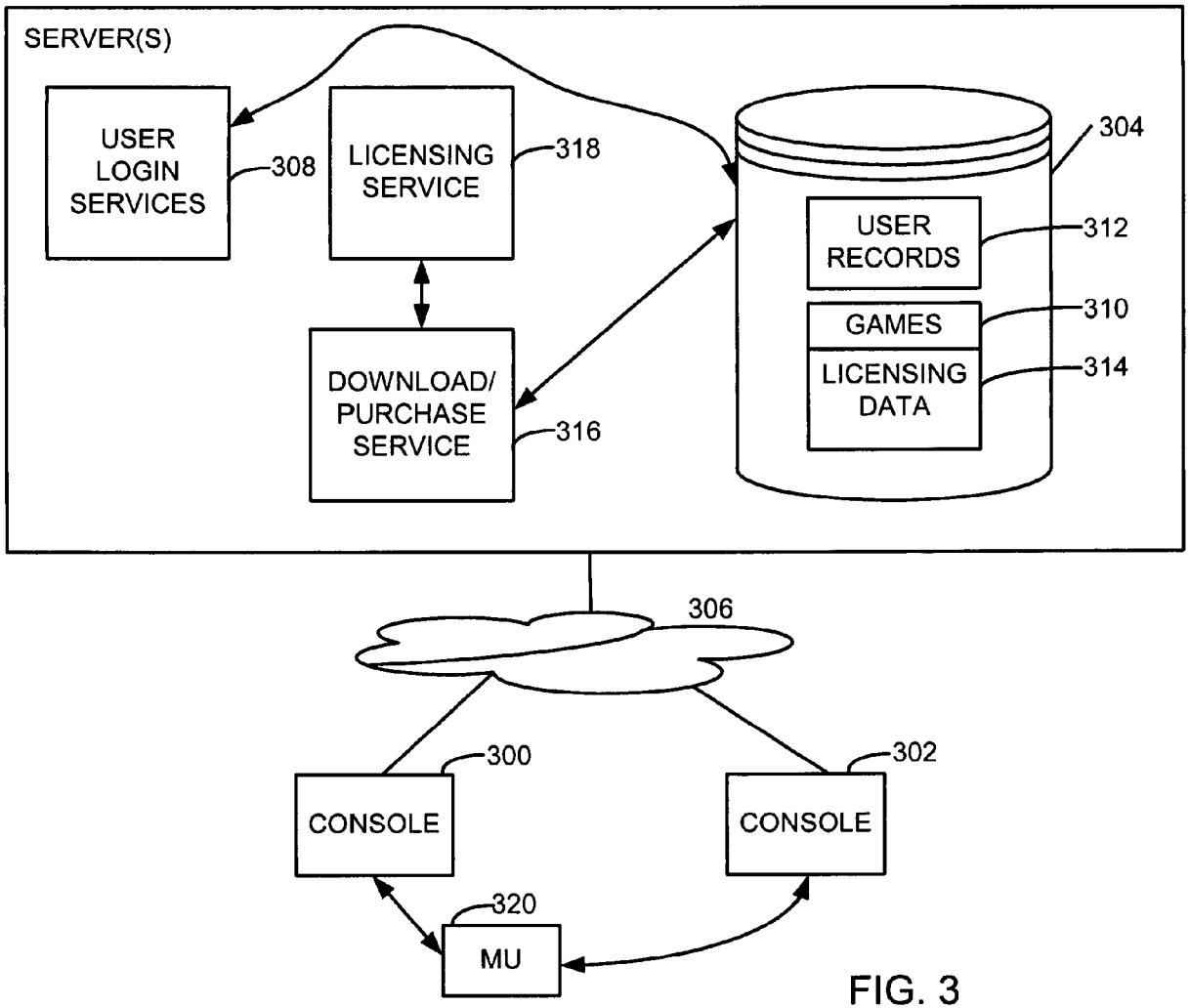
FIG. 3 is a block diagram of consoles networked with one or more servers.

FIG. 3 provides a block diagram of multiple consoles 300 and 302 networked with one or more servers 304 through a network connection 306. In one embodiment, network connection 306 comprises the Internet. Servers 304 provide a collection of services that applications running on console 300 may invoke and utilize. For example, consoles 300 and 302 may invoke user login services 308 which are used to authenticate a user on consoles 300 and 302 by obtaining a game word tag and a password from the user. User login services 308 access user records 310 in a database 312, which may be located on the same server as user login services 308 or may be distributed on a different server or a collection of different servers. User records 310 include the Gamertag and password that allow a user to be authenticated by user login services 308. User records 310 also include additional information about the user including games that have been downloaded by the user, and licensing packages that have been issued for those downloaded games, including the permissions associated with each licensing package. In addition, user records 310 can include financial information about the user including a credit card number associated with the user account and an account balance stored for the user in terms of points instead of dollars to allow for micro-payments. For example, $20 may purchase 1600 points. These points may be purchased through the credit card or redeeming gift cards through consoles 300 and 302. The points may be redeemed to purchase one or more games 314 stored on database 312 through a download purchase service 316. In addition to full games 314, points may be redeemed to purchase content for games previously downloaded to a console 300, 302. This content can include additional levels, maps, characters, equipment and other items that may be used to expand play on a game on consoles 300, 302.

When a game or content is purchased, a licensing service 318 is used to generate licensing packets that provide permissions allowing the game or content to be played on the console. Under one embodiment, licensing service 318 generates a user license package and a machine license package with each download. The user license package allows a user logged into servers 304 to use the content or game regardless of the console that the user is playing on. The machine license allows any user on the console the content or game is downloaded to, to use the game or content. In several embodiments, licensing service 318 include cryptography elements that allow it to encrypt the licensing packages to prevent access to the licensing package except by the console that the licensing package is downloaded to, which uses a key to decrypt the licensing package and except permissions for the user and the console based on the licensing packages. Typically, the licensing package forms part of the downloaded content or game so that when the content or game is copied onto a memory unit such as memory unit 320 the licensing package accompanies the gaming content. Portable memory unit 320 may be moved between console 300 and 302 so that content stored on memory unit 320 from console 300 may be read by console 302.

Figure 4:
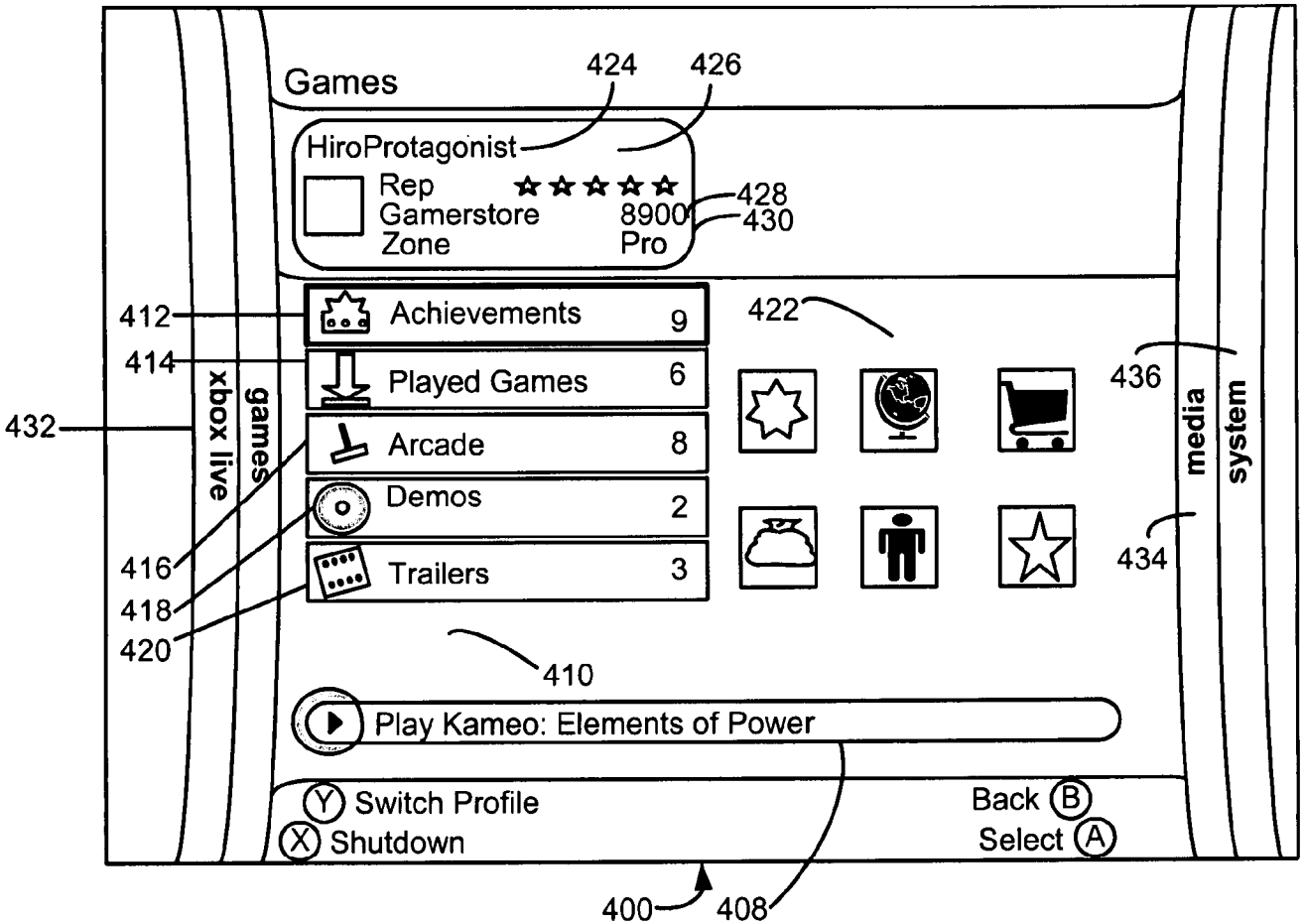
FIG. 4 is an example of a games blade user interface.

FIG. 4 provides an example of a games blade user interface that is illustratively presented to a user of a console as described. In FIG. 4, games blade 400 is shown to contain a title 402, a gamer card 404, a banner area 406, a banner area 408 and a menu listing 410 consisting of achievements 412, played games 414, arcade games 416, demos 418 and trailers 420. Elements in listing 410 may be highlighted using an associated game controller. When an element is highlighted, icons and text relative to the highlighted appear in area 422. For example, in FIG. 4, the achievements element 412 is highlighted resulting in icons being displayed in area 422 that represent different games and the achievements that the user has acquired for those games.

Gamer card 404 includes information about the current user. This information includes current user's Gamertag 424, their reputation 426, their Gamerscore 428 and their preferred zone of play 430.

The user interface of FIG. 4 also provides tabs 432, 434 and 436, which can be used to bring up an XBox live blade, a media blade and a system blade, respectively. The XBox live blade 432 is an interface dedicated primarily to enabling access to networked-based system resources. The media blade 434 allows the user to interact with different forms of media that may be attached to the console or stored on the hard disc drive of the console. System tab 636 allows the user to bring up a system blade that provides options for the console.

Figure 5:
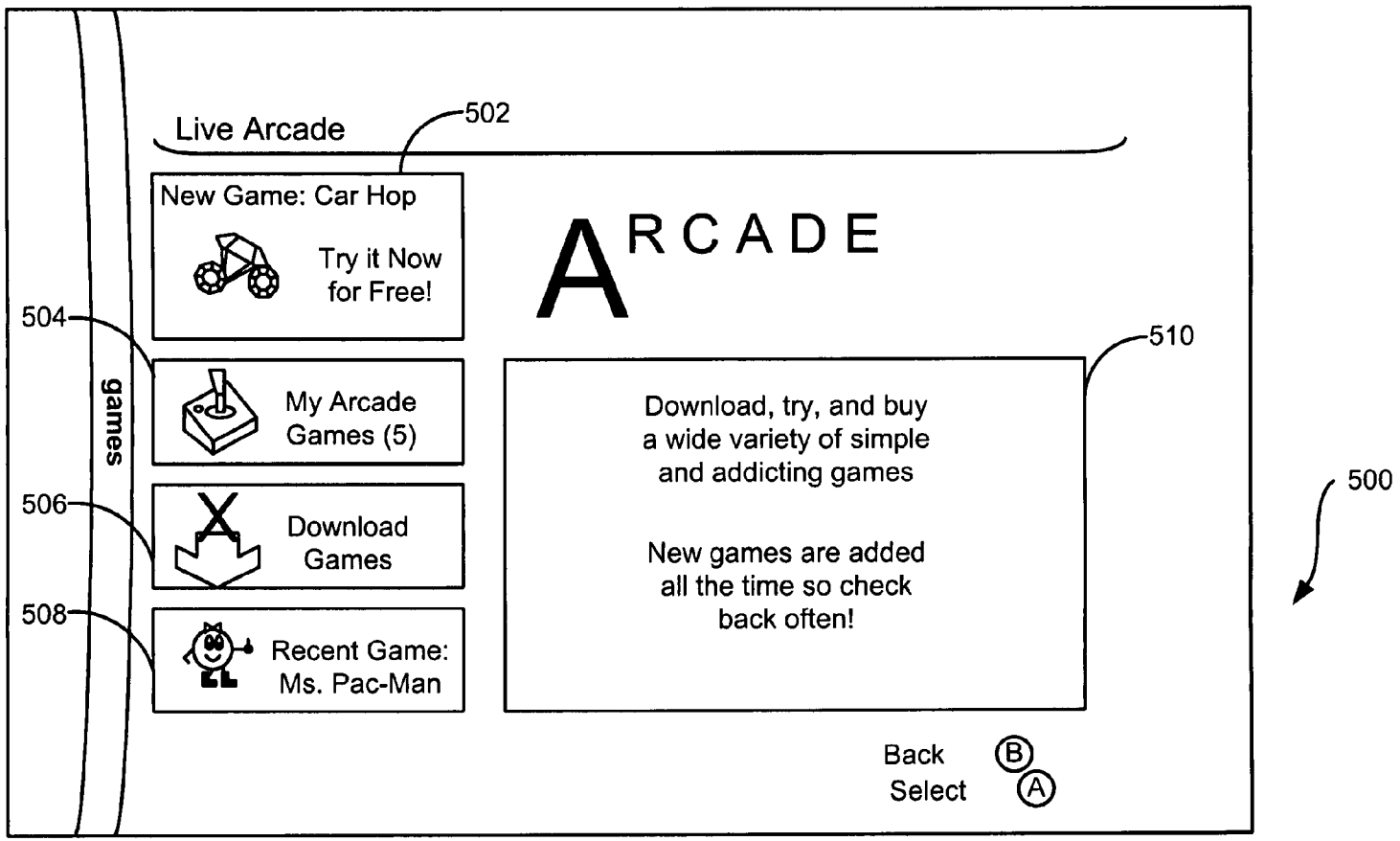
FIG. 5 is an example of an arcade user interface.

From games blade 400, the user can open an arcade page by selecting arcade element 416 in list 410. An example of the arcade page is shown on FIG. 5. In FIG. 5, the arcade page 500 is shown on the games blade and includes a banner area 502, a "my arcade games" menu item 504, a download games menu item 506 and a recent game menu item 508. The menu items 504, 506 and 508 may be highlighted using the game controller. When a menu item is highlighted, a description of the item is shown in description area 510. Banner 502 can contain advertisements for games that can be downloaded, including free demos of games as is indicated in FIG. 5 where the game "car hop" is advertised for download. Area 510 may also contain advertisements in certain states.

Menu item 504, when selected, brings up a "my arcade page," which lists the demonstration games and full version games that the user has downloaded to their machine. When menu item 506 is selected, a page of arcade games that can be downloaded to the user's machine is presented to the user. Thus, the user is provided with access to two separate menu items, one that allows the user to see all of the games that have already been downloaded to their machine, and the other providing a list of games that the user can download to their machine. It should be noted that, in one embodiment, the arcade page of FIG. 5 is not stored on an optical disc, but instead is stored in the flash memory of the gaming console. As a result, the user does not have to enter a disc in order to see the games stored on their machine or to view games that they could download to their machine.

As has been alluded to, a user can illustratively demo a game on a limited basis. Subsequently, if desired, the user can purchase access to the game with the limitation or limitations removed. The demo is likely to be either free or available for a price less than the price of the version without the limitations.

From a business standpoint, implementing this type of "try before you buy" model presents the challenge of convincing customers, the users, to download the demo or trial version of a game. One option is to incorporate marketing text, marketing images and/or game images into user interfaces in an attempt to persuade customers that the demo or trial version of a game is worth downloading. Audio and/or video promotions can alternatively or additionally be implemented. In general, these options are primarily marketing focused.

There are alternatives to these primarily marketing focused approaches to enticing customers to download a demo or trial version of a game. Another option is to appeal to a user's desire to grow their personal collection of achievements on a gaming platform.

Before describing in detail how achievements can be implemented to encourage demo or trial downloads, it may be worth a brief digression to the concept of achievements in general. A typical user's gaming history is littered with all manner of milestones such as, but not limited to, the completion of games, earning of high scores, setting of records, winning of user versus user competitions, etc. Traditionally, the user completes such goals and basks in their glory. In one embodiment, the console converts these types of victories into tangible and viewable awards. These awards are represented as "achievements" in user interfaces associated with the gaming console. In one embodiment, a user is able to access and display their own achievements. In another embodiment, a user is able to access and display the achievements of their friends or competitors. Thus, a user can compare his or her achievement to the those of a particular friend or competitor. In one embodiment, the gaming console need not necessarily be booted up to review achievement information. For example, achievement information may be accessible through a different computing means, such as being made available on a World Wide Web site maintained on the Internet.

Achievements can be as simple, as complex, or as off the wall as any of the following examples:

Finish the game

Earn a 100% rating for finding all secrets and items

Beat a level or the entire game within a set time limit

Beat a player online ranked several levels higher than you

Compete with or against someone from a different country

Beat all the preset high scores

Finish a level in a stealth game without ever being spotted

In one embodiment, certainly not by limitation, a developer is able to offer up achievements for their own game or games. Achievements can be as simple or extraordinary as the developer wants them to be.

As was mentioned in reference to FIG. 4, a given user illustratively has a profile associated with a gamer card 404. That profile includes a "gamerscore" that is a general indication of gaming experience. In one embodiment, a user's gamerscore is affected directly by achievements as they are obtained.

In one embodiment, achievements are tracked and maintained even if the console is not connected via a network to the server. When and if the console is eventually connected to the server, the achievements saved locally (e.g., on the console hard drive, on an associated memory unit, etc.) are uploaded, for example, so as to become discoverable to users of other consoles.

In order to encourage a user to download a trial or demo version of a game, an appeal can be made to the user's desire to hold rare achievements, such as achievements that are limited to a select portion of the gaming community. In one embodiment, a "dynamic achievement challenge" model is employed. This model encourages users to download a game by providing an incentive in the form of an achievement that will only be available for a limited time. Promotions of a particular achievement opportunity can be exposed in any of the console user interfaces such as, but not limited to a games blade (e.g., screenshot 400 in FIG. 4) and/or an arcade interface (e.g., interface 500 in FIG. 5). In one embodiment, when a user selects one of these promotions, they are taken (e.g., the display transitions to) a download screen for the game that is configured to reward the associated limited time achievement.

Thus, in one embodiment, achievements that are limited in time are utilized to drive commercial traffic in the console gaming space. In one embodiment, such achievements are utilized to encourage downloading of a game that can be played either online or offline in the future. The use of limited time achievements to drive downloads of games is likely to increase the number of users that download trial download games.

From a business standpoint, another challenge associated with the "try before you buy" model is the challenge of convincing customers, the users, to convert the trial or demo version of a game into the full version. To some extent, limitations associated with the demo or trial version act as an incentive. For example, customers are provoked toward upgrading to full access in order to have the game play limitations removed. Limitations on the demo version might include, but are not limited to, a restriction on how long access is available, a restriction based on how much of the game is available, a restriction based on features available within the game, and/or some other restriction.

There are alternatives to the limitation-based approach to enticing customers to convert to the full version of a game. Another option is to utilize an achievement as an incentive to convert. For example, as has been described, a user may earn an achievement by playing a trial or demo version of a game. In one embodiment, when the user is notified of the achievement accomplishment, they are also notified that unless they upgrade to the full version of the game, they will be unable to record the newly earned achievement in their profile. Thus, in effect, unless they purchase the full version of the game, the achievement will be lost.

Figure 6:
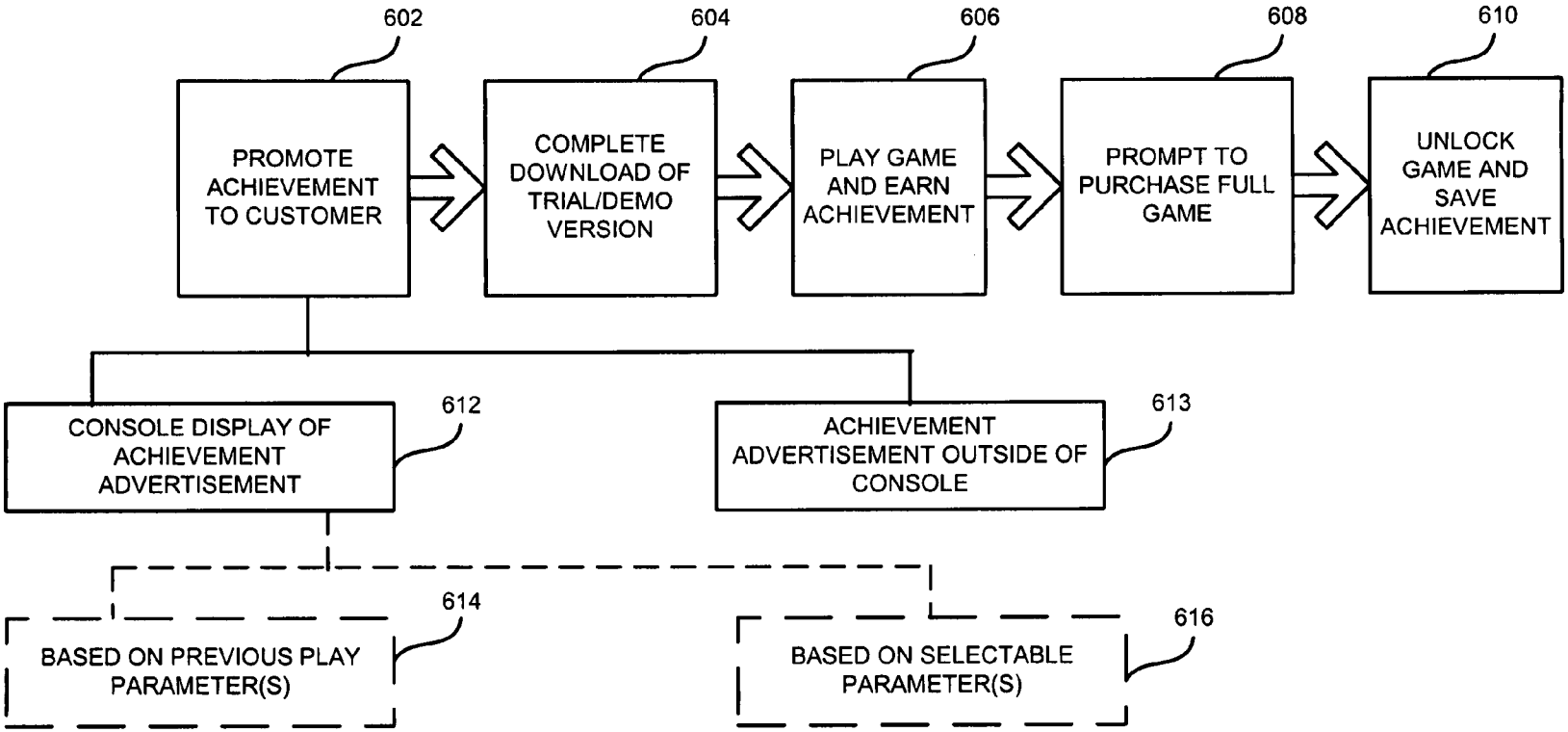
FIG. 6 is a flow chart demonstrating steps associated with converting a demo version of a game into a full version of the game.

FIG. 6 is a flow chart diagram demonstrating steps associated with utilizing achievements to drive download and purchase behaviors. Step 602 represents making a potential customer (e.g., a user of the console gaming system) aware of an opportunity to add an achievement to their collection by downloading and playing a demo or trial version of a particular game. In one embodiment, this means advertising an achievement opportunity that will expire after a certain period of time, or after occurrence of a predetermined event.

As is indicated by block 613, the promotion step 602 can include an achievement advertisement outside of the console. Example of where such advertisements might appear include, but certainly are not limited to, web sites, billboards, magazines, etc. In one embodiment, a user collects a code (e.g., a password) from an advertisement outside of the console. The user can then enter the code into the console in order to "unlock" an opportunity to earn an achievement, for example by downloading and playing an associated demo version of a game. These types of unlocked achievements could also or alternatively be linked to full game versions without departing from the scope of the present invention.

As is indicated by block 612, the promotion step 602 can involve utilizing a display system integrated into the console to display an achievement advertisement in an interface component provided as an output of the console. For example, step 612 can involve utilizing a banner display system to display an achievement advertisement in a banner provided as an output of the console. In a more specific example, an achievement advertisement can be incorporated into banner area 502 and/or description area 510 (e.g., when button 506 is highlighted) in arcade page 500 (FIG. 5). In addition or alternatively, a banner advertisement can be incorporated into area 422 (e.g., when demo button 418 is highlighted) and/or area 408 of games blade 400 (FIG. 4). Of course, these are only examples of how achievement advertisements might be implemented. Those skilled in the art will appreciate that there are certainly many other alternatives within the scope of the present invention.

In one embodiment, the console system is configured to support the selective display of achievement advertisements based on one or more parameters. The precise nature of such parameters can vary from one implementation to the next. One example of a parameter that can be imposed, which is represented by block 614, is a parameter based on previous game play. For example, the console can be configured to only display advertisements if the currently active user has not already played the associated game. The system illustratively determines what particular games the user has already played by referencing profile information maintained locally on storage within the console, on a portable storage device, and/or on a remote server accessible to the system.

Another example of a parameter that can be imposed, which is represented by block 616, is a selectable parameter such as, but not limited to a timing parameter (e.g., a scheduled date/time that a particular advertisement will run). In one embodiment, a developer of a game is able to assign parameters to be applied to achievements. In one embodiment, a software development kit is provided to a developer and includes support for creating achievements and establishing parameters to be applied to their display. In one embodiment, the development kit enables the creation of achievement opportunities that will expire upon expiration of a predetermined amount of time and/or after occurrence of a particular event.

It is worth mentioning that achievement opportunities are not necessarily limited to being offered when a game is made available for downloading to the console. For example, a developer whose game is released and made available for download in January of a given year can create an achievement opportunity in July of the same year. This might be desirable to the developer in order to create am incentive to encourage increased trial or demo downloads and/or an increased purchase rate of the full game mode.

In accordance with block 604, the next step in the process is for the user to download a trial or demo version of a game associated with an achievement opportunity. In one embodiment, when a user responds to a console achievement advertisement by selecting (e.g., through a control input) the advertisement, then a display of information pertaining to the associated game (e.g., screenshots, descriptive text, etc.) is initiated. An offer to try a demo or trial version of the game is displayed. The user inputs an indication of acceptance (e.g., by selecting a "download now" option) and the game is downloaded to the console.

Once the game is downloaded, the user is presented with a "play now" option. When this option is selected, game play begins. In one embodiment, at launch, a request is made by the game for licensing information from the console system (and/or from a connected server) indicating whether or not the game should be launched in demo or full game mode. Assuming the customer has only downloaded the demo game, licensing information is returned indicative that only the demo mode should be made available.

In accordance with block 606, game play leads to the earning of an achievement that is available in the game. In accordance with block 608, when the user earns an achievement, the game client initiates a corresponding notification to the user (e.g., through display of user interface components). The game client is illustratively configured to recognize that the game was launched in trial mode, and to therefore withhold actual recording of the achievement. Instead of recording the achievement, the game client illustratively initiates a notification to the user (e.g., through display of user interface components) that the achievement will not be recorded unless they purchase the full version of the game at that time. If the user desires to keep the achievement they have earned, they must convert to a full version of the game. In one embodiment, this entails selecting an "unlock full game option" and completing a purchase process.

In one embodiment, completing the purchase process involves downloading a new series of license bits to attach to the existing game content package that is already on the user's console (i.e., as a result of downloading the demo version of the game). In other words, the full game is downloaded when the demo version is requested, but the full version is not available until the updated licensing information is obtained as a result of the purchase process.

In one embodiment, once a user has completed the purchase process, the game receives a message indicating that the license bits associated with the game have changed. The game then checks the licensing bits to confirm whether the full game has been purchased. If so, a process for recording the achievement is executed, and, in one embodiment, the user is allowed to proceed within the game with demo limitations removed.

Figure 7:
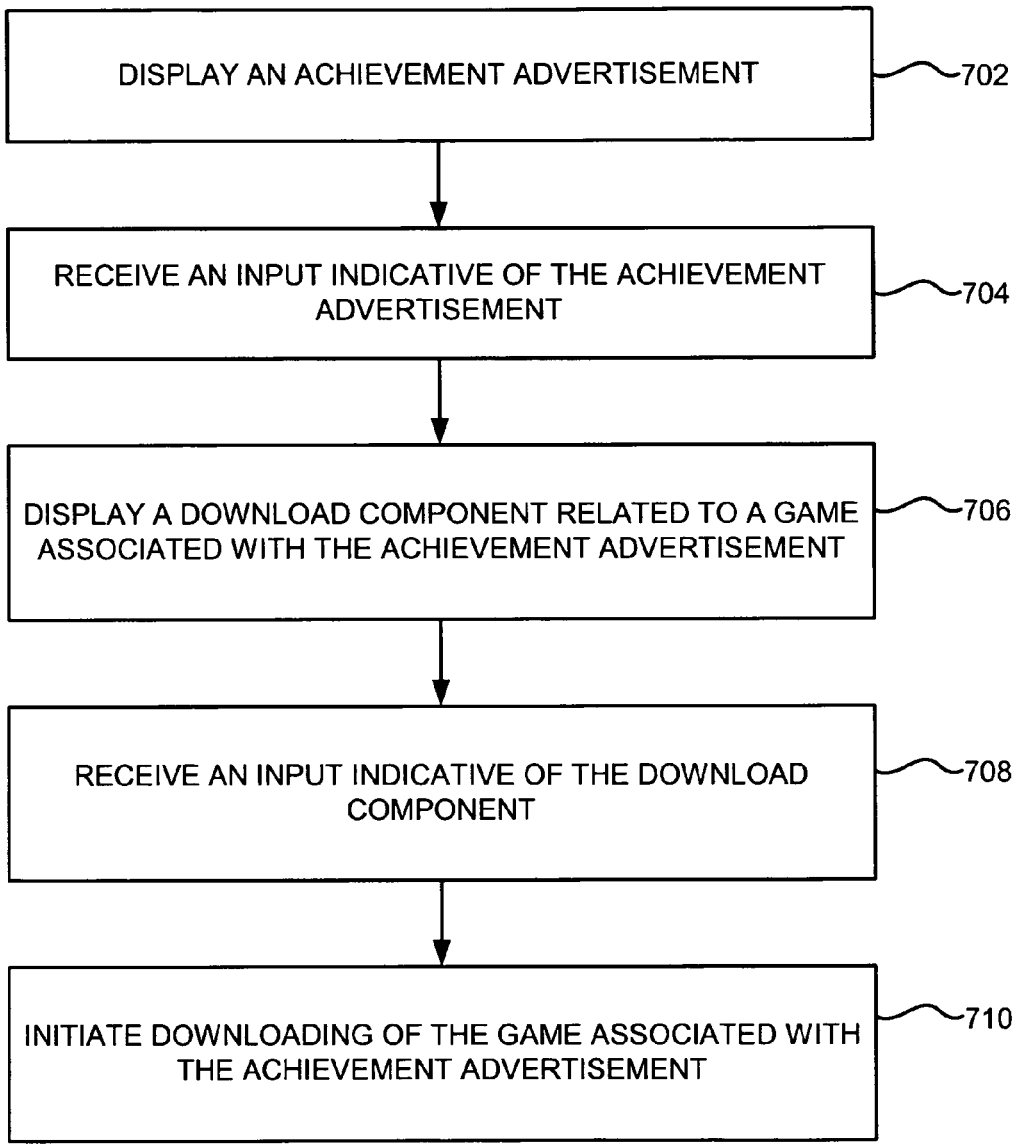
FIG. 7 is a flow chart demonstrating steps associated with downloading a game.

FIG. 7 is a flow chart diagram demonstrating steps associated with a streamlined download process. In accordance with block 702, an achievement advertisement is displayed. In one embodiment, the advertisement promotes an achievement opportunity that expires after a predetermined time period and/or after occurrence of a predetermined event. In one embodiment, the advertisement promotes a demo or trial version of a particular game. In accordance with block 704, an input is received (e.g., by way of a controller communicatively connected to the console) and is indicative of the achievement advertisement. In accordance with block 706, upon receipt of the input, a download component is displayed and is related to a game associated with the achievement advertisement. In accordance with block 708, an input is received (e.g., by way of a controller communicatively connected to the console) and is indicative of the download component. Finally, in response to the latter input, downloading of the game associated with the achievement advertisement is initiated. In one embodiment, this means a downloading license bits consistent with access on a demo or trial basis. Thus, in two user selections, the process of downloading a game from a server to the console can be initiated.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A computer-implemented method comprising:

displaying an achievement advertisement to a user that is selected based at least in part on user profile information associated with the user, wherein the displayed achievement advertisement renders information to the user that identifies an achievement and an opportunity for the user to acquire the achievement, by completing a gameplay objective during gameplay of a game, the gameplay objective being specifically identified within the achievement advertisement;

receiving an input from the user indicative of the achievement advertisement; and utilizing a processor that is a component of a computer to respond to the input by displaying a selectable download component that facilitates a download of a demo version of the game.

2. The method of claim 1, wherein the user profile information identifies games that have been played by the user and the achievement advertisement is selected based on the identified games.

3. The method of claim 2, further comprising requiring the user to complete the gameplay objective during gameplay of the demo version of the game in order for the user to possess the achievement, and wherein the achievement advertisement is associated with a game that the user has not played.

4. The method of claim 2, further comprising requiring the user to complete the gameplay objective, comprising a particular task, during play of the demo version of the game in order to possess the achievement, and wherein the achievement advertisement indicates that the achievement is only available for a limited time.

5. The method of claim 4, wherein the particular task and the limited time are specifically identified by the information rendered to the user within the achievement advertisement.

6. The method of claim 1, wherein the achievement advertisement identifies an opportunity to add the achievement to a collection of achievements, earned by the user, that are recorded in a user profile of the user, the method further comprising determining that the user has earned the achievement identified in the achievement advertisement.

7. The method of claim 6, further comprising providing a notification to the user that the earned achievement may not be kept unless the demo version of the game is upgraded to a non-demo version, and wherein licensing information is utilized to determine whether the earned achievement is kept or lost.

8. The method of claim 7, further comprising maintaining the achievement as a component of a selectively displayable award in a user interface component, and wherein receiving the input from the user includes receiving an indication of a code that is utilized to unlock an opportunity to earn the achievement.

9. The method of claim 1, wherein the achievement advertisement also includes an indication of a limited amount of time during which the achievement associated with the achievement advertisement will be available to the user, and wherein the limited amount of time is based at least in part upon an occurrence of a predetermined event.

10. The method of claim 9, wherein the indication of the limited amount of time is identified within the achievement advertisement as a limited amount of time during which the download of the demo version of the game and a purchase of a full version of the game must occur in order for the achievement to be available.

11. The method of claim 1, wherein the achievement advertisement further comprises an indication of circumstances under which an opportunity for the user to possess an achievement associated with the achievement advertisement will expire, and wherein the achievement advertisement provides an opportunity to transfer the user to a download screen associated with the game.

12. The method of claim 1, wherein displaying an achievement advertisement comprises displaying a limited time achievement advertisement, and wherein the achievement advertisement is displayed in a user interface of a video game operating system.

13. The method of claim 1, wherein displaying an achievement advertisement comprises displaying based upon a parameter selected by a developer of the demo version of the game, and wherein achievement information is made available to multiple users through a network connection.

14. A computer-implemented method comprising:

displaying an achievement advertisement that identifies an achievement and an opportunity to obtain the achievement during gameplay of a game, while at the same time displaying an indication of access to a mechanism for initiating a download of a demo version of the game, wherein the achievement advertisement identifies obtaining the achievement as being contingent at least in part upon occurrence of the download of the demo version of the game and specifically identifies a time within which a condition of the achievement must be satisfied in order to achieve the achievement;

determining that a user has satisfied the condition of the achievement, within the identified time, during a gameplay of the demo version of the game; and utilizing a processor that is a component of a computer to selectively record the achievement into a user profile associated with the user based at least in part upon a purchase of a full version of the game.

15. The method of claim 14, wherein the time within which the condition must be satisfied is identified by at least one of: a predefined period of time and occurrence of a predetermined event.

16. The method of claim 14, wherein displaying the opportunity to obtain the achievement comprises displaying in response to a determination made based at least in part on a selectively adjustable parameter and information stored in the user profile.

17. The method of claim 14, wherein displaying the opportunity to obtain the achievement further comprising restricting the opportunity to obtain the achievement so as to require a user to play the demo version of the game in order for the user to obtain the achievement, and wherein the achievement is added to a collection of achievements.

18. The method of claim 14, further comprising requiring the user to complete one of multiple predetermined objectives during play of the demo version of the game in order to obtain the achievement.

* * * * *